United States Patent [19]

Kruse et al.

[11] Patent Number: 4,884,508

[45] Date of Patent: Dec. 5, 1989

[54] SPIN STABILIZED CARRIER PROJECTILE EQUIPPED WITH A DRIVING BAND

[75] Inventors: Heinz-Josef Kruse, Ratingen; Klaus D. Karius, Jüchen; Achim Sippel, Ratingen, all of Fed. Rep. of Germany

[73] Assignee: Rheinmetall GmbH, Düsseldorf, Fed. Rep. of Germany

[21] Appl. No.: 247,623

[22] Filed: Sep. 22, 1988

[30] Foreign Application Priority Data

Oct. 8, 1987 [DE] Fed. Rep. of Germany ..... 3734033

[51] Int. Cl.[4] ..... F42B 31/00

[52] U.S. Cl. ..... 102/524; 102/357; 102/489

[58] Field of Search ..... 102/473, 489, 340, 342, 102/351, 357, 524–527

[56] References Cited

U.S. PATENT DOCUMENTS

| | | | |
|---|---|---|---|
| 443,101 | 12/1890 | Maxim | 102/524 |
| 3,301,186 | 1/1967 | Henry | 102/524 |
| 4,803,929 | 2/1989 | Kruse | 102/524 |

FOREIGN PATENT DOCUMENTS

| | | | |
|---|---|---|---|
| 1166011 | 11/1958 | France | 102/473 |
| 1231601 | 9/1960 | France | 102/524 |

*Primary Examiner*—Harold J. Tudor

*Attorney, Agent, or Firm*—Spencer & Frank

[57] ABSTRACT

The present invention relates to a spin-stabilized carrier projectile having a projectile base which is connected with a projectile body for carrying sub-ammunition projectiles, and a driving band arrangement connected respectively about the projectile base and about the projectile body for engaging the rifling of the gun barrel to impart spin respectively to the projectile base and the projectile body. The driving band arrangement includes a first partial driving band connected coaxially about the projectile base and a second partial driving band connected coaxially about the projectile body. This driving band arrangement reduces the spin forces transferred by the joint between the projectile base and the projectile body, thereby reducing the required joint strength. This in turn reduces the required ejection charge used to separate the projectile body and projectile base for release of sub-ammunition bodies contained in the carrier projectile.

16 Claims, 2 Drawing Sheets

SPIN STABILIZED CARRIER PROJECTILE EQUIPPED WITH A DRIVING BAND

BACKGROUND OF THE INVENTION

The present invention relates to a spin stabilized carrier projectile having a projectile base connected to a projectile body, and a driving band connected to the carrier projectile for transferring spin forces thereto.

In spin stabilized projectiles, the projectiles are equipped with driving bands which are used for sealing as well as for transferring the spin from the rifling of a gun to the respective projectiles. The driving bands have outer diameters which are sufficiently large that they engage the rifling of a gun barrel as the projectile passes therethrough.

If the projectile is a carrier projectile which contains sub-ammunition bodies in its interior, the driving band is conventionally disposed either on the projectile base or on the projectile body. If the driving band is on the base of the projectile, the transfer of torque or spin forces between the base and the body generally is effected by means of a pin or a screw connection. In the past, a screw connection was employed for thick-walled bodies. For manufacturing reasons and strength considerations, a pin connection has advantages for use in connection with thin-walled bodies. To ensure secure transfer of torque to the projectile body where a pin connection is used in the prior art, a plurality of such pins are arranged about the circumference of the projectile body. This prior art arrangement requires that the projectile carry a relatively large ejection charge which is necessary to cause shearing off of the pins during ejection of the subammunition bodies.

If the driving band is disposed on the projectile body, a relatively expensive radial supporting structure is required on the projectile body in the region of the driving band. Otherwise, the relatively large radial pressure forces exerted on the driving band by the gun barrel would prevent the driving band from performing its sealing function. Particularly when thin projectile bodies are employed (in which the ratio of the wall thickness of the projectile body to the gun barrel caliber is customarily $<0.05$), the projectile reacts with particular sensitivity to radial pressures, since at various locations (depending on the projectile geometry) high material stresses may occur.

SUMMARY OF THE INVENTION

It is therefore an object of the present invention to provide a carrier projectile of the above-mentioned type in which the requirement for torque transfer between the projectile body and the projectile base is eliminated and in which there is no requirement for an expensive supporting structure for the projectile body the region of the driving band. The above and other objects are accomplished according to the invention by the provision of a spin stabilized carrier projectile including:

(a) a projectile base;

(b) a projectile body connected to the projectile base; and (c) a driving band arrangement for transmitting torque to the projectile base and the projectile body, the driving band arrangement being connected about the projectile base and the projectile body.

The carrier projectile according to the invention distributes the connection of the driving band arrangement to the projectile body and to the projectile base in such a manner that both receive a direct transfer of the spin forces caused by the engagement of the gun barrel rifling with the driving band arrangement. By distributing the connections of the driving band arrangement to the body and the base in correspondence with their respective axial rotational moments of inertia, there is no required transfer of spin forces between the projectile body and the projectile base, as had been required in the prior art. The connection between the projectile body and the projectile base can therefore be constructed to meet other ejection requirements (e.g. to minimize required shearing forces to shear the connecting pins during ejection of the sub-ammunition). For example, in one embodiment only two connecting pins are required according to the invention instead of eight pins as required by the prior art projectile discussed hereinabove, thereby contributing to minimizing the greatest stresses on the projectile during ejection of the sub-ammunition therefrom.

The invention will be described in greater detail below with reference to an embodiment which is illustrated in the drawings.

DETAILED DESCRIPTION OF THE PREFERRED EMBODIMENT

Figure 1:
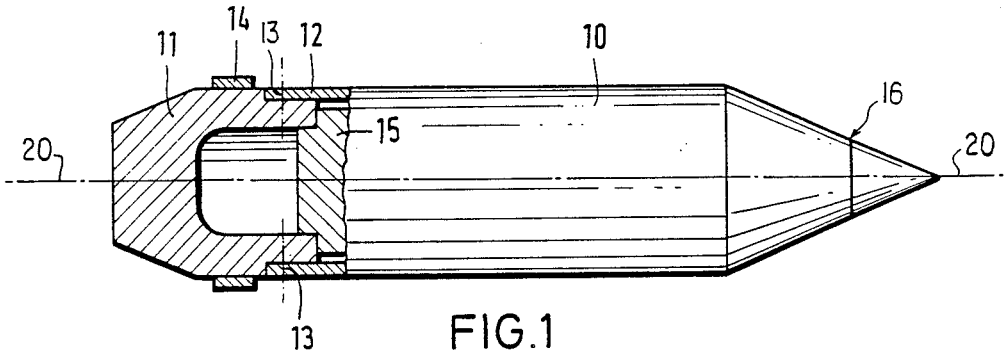
FIG.1 (PRIOR ART)
FIG. 1 is a partially sectional side elevational view of a prior art carrier projectile having a driving band which is schematically shown as being connected to the base of the carrier projectile.

Referring to FIG. 1, a prior art carrier projectile 10 is provided at its tail end with a projectile base 11 which is connected with a projectile body 12 by a plurality of shear pins 13. A plurality of sub-ammunition bodies 15 are disposed in the interior of the carrier projectile 10, only a tail portion of one of the sub-ammunition bodies 15 being shown in FIG. 1. A driving band 14 is coaxially disposed about the longitudinal axis 20 of the projectile 10, the driving band 14 having a diameter which is sufficiently large that it is fully engaged with the rifling of a gun barrel when the carrier projectile 10 passes therethrough. The rifling of the gun barrel causes the driving band 14 to spin, in turn causing the projectile base 11 to spin. The projectile body 12 is caused to spin by transmission of spin forces thereto from the projectile base 11 via the shear pins 13. To ensure reliable spin transfer, the prior art carrier projectiles require about eight such shear pins 13.

When the carrier projectile 10 has reached a given target area, the sub-ammunition projectiles 15 are ejected. This ejection can be caused, for example, by a pyrotechnic charge or ejection charge (not shown) that is ignited in the nose portion 16 of the carrier projectile 10, detonation of the pyrotechnic charge pressing the sub-ammunition projectiles 15 to the rear of the projectile carrier 10 so that, if the resulting pressure inside the carrier projectile 10 is sufficiently high, the pins 13 are sheared off.

Figure 2:
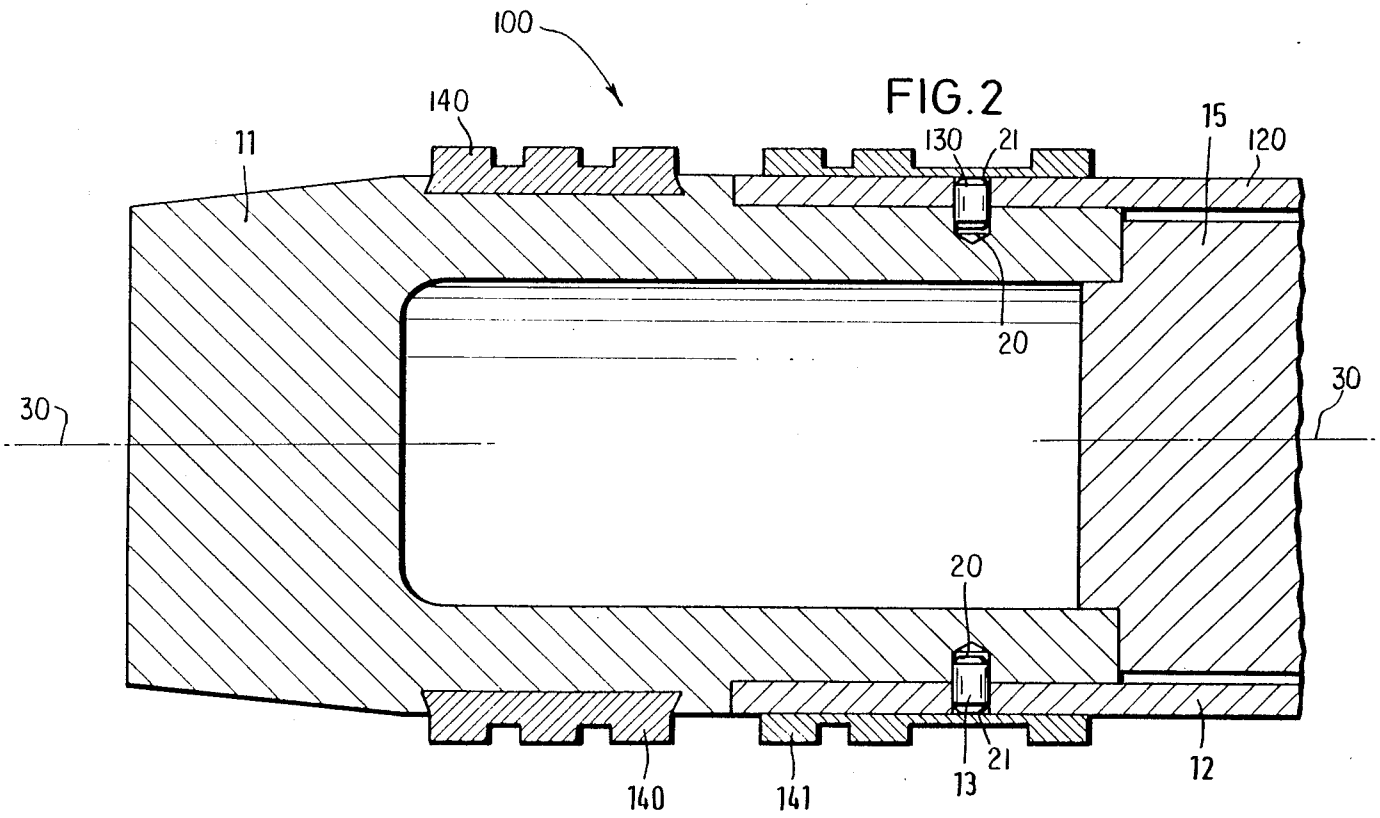
FIG. 2 is an enlarged sectional view of a rear portion of a carrier projectile having a driving band arrangement according to the present invention.

FIG. 2 shows a carrier projectile 100 according to the invention, having a projectile base 110, which is of the same type as the projectile base 11, and a projectile body 120, which is of the same type as the projectile body 12 in the prior art projectile 10. The projectile base 110 and the projectile body 120 are connected together by two shear pins 130. A tail portion of a sub-ammunition body 15 is also shown and is of the same type as that shown in FIG. 1. A driving band arrangement includes a pair of first and second partial driving bands 140 and 141 which are fastened to the projectile 100. The first partial driving band 140 is disposed coaxially about the projectile base 110 and is fastened thereto. The second partial driving band 141 is disposed coaxially about the projectile body 120 and is connected thereto at a region of the projectile body 120 which overlaps the projectile base 110.

The first and second partial driving bands 140 and 141 together produce a direct transfer of spin forces respectively to the projectile base 110 and the projectile body 120. Therefore, unlike the prior art spin-stabilized projectile carriers, there is no requirement for spin transfer (i.e., transfer of torque) between the projectile base 110 and the projectile body 120. Thus, the number of required shear pins is reduced as compared to the prior art carrier projectile 10 discussed hereinabove (e.g. in one embodiment of the invention, only two shear pins 130 are required), consequently the amount of the ejection charge required to shear off the shear pins 130 can be reduced considerably as compared with the prior art projectile 10. Ultimately, this results in a considerable reduction of stress on the projectile 100 during ejection of the sub-ammunition projectiles 15.

Different materials may be used respectively for the first and second partial driving bands 140 and 141. The first partial driving band 140, which is disposed at the projectile base 110 could, for example, be made of copper and the second partial driving band 141, which is disposed on the projectile body 120, could be made of soft iron. As suggested by FIG. 2, it is possible to fasten the first partial driving band 140 to the projectile base 110 by pressing or shrinking of the first partial driving band 140 (e.g. by a process such as heat shrinking) onto the projectile base 110. In the preferred embodiment, the second driving band 141 is fastened to the projectile body 120 by three welds. The exemplarily indicated different materials and respective different manners of fastening are selected because the thin wall of the projectile body 120 would not permit a copper partial driving band to be shrunk on, and therefore soft iron is preferably used instead for the driving band 141. The projectile base 110, however, due to its relatively large wall thickness, does permit shrinking thereon of a partial driving band 140 which is composed of copper. Generally, copper is preferred as the driving band material because it produces less wear on the gun barrel.

As seen in FIG. 2, a pair of bores 20 are formed in diametrically opposite sides of the projectile base 110 and are aligned respectively with a pair of bores 21 which are formed through diametrically opposite sides of the projectile body 120. A pair of shear pins 130 are respectively received in the corresponding aligned bores 20 and 21, thereby forming a joint where the projectile body 120 overlaps the projectile base 110. Both of the shear pins 130 are disposed in the corresponding aligned bores 20 and 21 beneath the second partial driving band 141.

It will be understood that the above description of the present invention is susceptible to various modifications, changes and adaptations, and the same are intended to be comprehended within the meaning and range of equivalents of the appended claims.

What is claimed is:

1. A spin stabilized carrier projectile of the type adapted to enclose a plurality of sub-ammunition projectiles which are to be ejected from the carrier projectile over a target area, the carrier projectile comprising:

(a) projectile base;

(b) a thin walled projectile body;

(c) releasable connecting means for fastening said projectile base to said projectile body such that the plurality of sub-ammunition projectiles are enclosed between said projectile base and said projectile body, said connecting means being breakable during flight of the carrier projectile to permit ejection of said plurality of sub-ammunition projectiles;

(d) a first driving band surrounding said projectile base, said first driving band being connected to said projectile base for engaging rifling of a gun barrel for transmitting spin forces to said projectile base during discharge from a gun barrel; and (e) a second driving band surrounding said projectile body, said second driving band being connected to said projectile body for engaging rifling of a gun barrel for transmitting spin forces to said projectile body during discharge from a gun barrel.

2. A spin stabilized carrier projectile as defined in claim 1, wherein said first and second driving bands are respectively composed of different materials.

3. A spin stabilized carrier projectile as defined in claim 2, wherein said first driving band is composed of copper.

4. A spin stabilized carrier projectile as defined in claim 2, wherein said second driving band is composed of soft iron.

5. A spin stabilized carrier projectile as defined in claim 1, wherein said releasable connecting means includes a pair of diametrically opposed shear pins, each said shear pin being disposed in said projectile body and in said projectile base to prevent relative movement between said projectile body and said projectile base.

6. A spin stabilized carrier projectile as defined in claim 1, wherein said projectile body has a wall which has a predetermined thickness , and the ratio of said predetermined thickness of said wall of said projectile body to the caliber of said projectile body is less than 0.05.

7. A spin stabilized carrier projectile as defined in claim 1, wherein said projectile body has an end which coaxially receives an end of said projectile base to form a joint, said joint being secured by said connecting means, and wherein said connecting means includes a plurality of shear pins.

8. A spin stabilized carrier projectile as defined in claim 7, wherein said end of said projectile base has a cylindrical peripheral surface.

9. A spin stabilized carrier projectile as defined in claim 7, wherein said end of said projectile body has a hollow tubular shape.

10. A spin stabilized carrier projectile as defined in claim 7, wherein said second driving band is coaxially disposed about said projectile body at said joint.

11. A spin stabilized carrier projectile as defined in claim 7, wherein each of said plurality of shear pins are received within respective aligned bores which are disposed in said projectile base and in said projectile body.

12. A spin stabilized carrier projectile as defined in claim 11, wherein each of said plurality of shear pins are disposed at locations within said respective aligned bores which lie beneath said second driving band.

13. A spin stabilized carrier projectile of the type adapted to be discharged from a gun barrel having rifling and enclosing a plurality of sub-ammunition projectiles which are to be ejected from the carrier projectile over a target area by separation of the carrier projectile, the carrier projectile comprising:

(a) a projectile base;

(b) a thin walled projectile body having an open rear end which coaxially receives a front end portion of said projectile base to form a joint;

(c) a first driving band connected to and surrounding said projectile base for engaging rifling of a gun barrel to impart spin to said projectile base during discharge from a gun barrel;

(d) a second driving band connected to said projectile body for engaging rifling of a gun barrel for transmitting spin forces to said projectile body during discharge from a gun barrel said second driving band being coaxially disposed about said joint; and (e) a plurality of shear pins connecting said projectile body and said projectile base together at said joint, with each of said plurality of shear pins being received within respective aligned radial bores in said projectile base and in said projectile body beneath said second driving band.

14. A spin stabilized carrier projectile as defined in claim 13, wherein said first and second driving bands are composed of different materials.

15. A spin stabilized carrier projectile as defined in claim 14, wherein said first driving band is composed of copper.

16. A spin stabilized carrier projectile as defined in claim 14, wherein said second driving band is composed of soft iron.

* * * * *